US005522162A

United States Patent [19]

Allison

[11] Patent Number: 5,522,162

[45] **Date of Patent: * Jun. 4, 1996**

[54] SNOW BLOWER SHOVEL

[76] Inventor: Peter Allison, 5012 N. Sedgewick, Lyndhurst, Ohio 44124

[ * ] Notice: The portion of the term of this patent subsequent to Dec. 19, 2009, has been disclaimed.

[21] Appl. No.: 810,113

[22] Filed: Dec. 19, 1991

[51] Int. Cl.[6] ..... E01H 5/09

[52] U.S. Cl. ..... 37/242; 37/246; 37/259; 37/241

[58] Field of Search ..... 37/246, 259, 244, ,37/242, 241, 285

[56] References Cited

U.S. PATENT DOCUMENTS

| | | | |
|---|---|---|---|
| 3,200,519 | 8/1965 | Kennedy | 37/242 |
| 4,255,880 | 3/1981 | McMickle et al. | 37/285 X |
| 4,295,285 | 10/1981 | Stevens | 37/246 |
| 4,329,792 | 5/1982 | Berner | 37/246 |

FOREIGN PATENT DOCUMENTS

| | | | |
|---|---|---|---|
| 734662 | 5/1966 | Canada | 37/246 |

*Primary Examiner*—Dennis L. Taylor
*Assistant Examiner*—J. Russell McBee

[57] ABSTRACT

A portable rotary snow blower shovel which is lightweight and maneuverable is disclosed. The device uses the drive mechanism from a rotary string trimmer. In place of the string and string guard, the snow blower utilizes an impeller and a substantially cylindrical enclosure. The enclosure includes a cutout opening in a lower portion of the periphery to allow snow to enter. Adjacent the opening is a flat plate which is secured to the inside of the enclosure at an angle in order to direct snow upward toward the impeller. The impeller, which is oriented substantially parallel to the surface being cleared, is circular in shape and has radially projecting blades attached to the upper and lower surfaces thereof. Once the snow is directed upward by the angled flat plate, the blades of the impeller, which are rotating at a high speed, force the snow out an exit conduit adjacent the top of the cylindrical enclosure by centrifugal force. The exit conduit directs the snow upward and away from the path being cleared.

7 Claims, 3 Drawing Sheets

SNOW BLOWER SHOVEL

BACKGROUND OF THE INVENTION

1. Field of the Invention

The invention relates to an attachment that changes the work function of devices known by many trade names such as WEEDWACKER, WEEDEATER and generically named string trimmer into a snow blower. When the seasons change the work function can also be changed back to the original string trimmer device. The invention detailed here is specific to 2.54 cm outside diameter curved drive tube models, however the concept may be used with a variety of models and manufactures limited only by size of the snow blower attachment and power requirements. The concept also lends itself to other possible devices using an inclined plane plow with an impeller to excavate a finely divided media.

2. Prior Art

Snow removal from public and private steps, walks, and driveways has evolved into different devices to accomplish the desired work an example being U.S. Pat. No. 4,378,644 which appears to be a complex, heavy and costly device compared to the snow blower shovel for accomplishing the same work the snow blower shovel does. While the majority of snow removal equipment is not easily stored as the snow blower shovel, equipment built thus far is heavy and large such as U.S. Pat. No. 4,597,203 and U.S. Pat. No. 4,679,338 which use an impeller disc as does the snow blower shovel. While the above inventions are not attachments U.S. Pat. No. 4,418,485 is a power take off device use to drive a snow blower from a tractor. There are also other devices such U.S. Pat. No. 3,200,519 a powered hand shovel blade and U.S. Pat. No. 3,431,661 which is an inclined plane snow plow device. However, no devices is known to have the configuration and properties of the snow blower shovel.

SUMMARY OF THE INVENTION

The principal object of this invention is to remove snow by converting the inexpensive and widely used lawn and garden tool, the string trimmer into a snow blower, although the concept of the impeller and inclined plane may be adapted to a variety other devices and attachments. The resulting snow blower will have some unique features that are unavailable on snow blowers, such as low cost, low weight, low storage space, increased maneuverability, ability to remove snow of any depth, and ability to remove snow from steps and walk-ways.

The unique features of the snow blower invention are the result of combining the inclined plane and high-speed impeller. The device works as follows: the unit is pushed into the media to be removed and the media (snow) is elevated up the inclined plane and into the high-speed centrifugal impeller. The media is forced out by centrifugal force into the exit conduit that guides snow to a selected dump area. The lightweight construction allows the user to turn the entire snow blower unit as needed.

User safety is of great concern in this application because of stored energy in the impeller. The flywheel effect may cause the impeller to disintegrate upon colliding with a higher density media(ice). However, the impeller is constructed of low density components (all Plastic) and also having a limited slip impeller construction to reduce this danger and increase user safety. The impeller blades are constructed to reduce air resistance and increase efficiency of operation.

In conclusion, the combination of the inclined plane and the impeller provide a new and improved snow blower that has broad applications in other fields in addition to increasing the usefulness of the string trimmer garden and lawn tool.

DESCRIPTION OF THE PREFERRED EMBODIMENT

Figure 1:
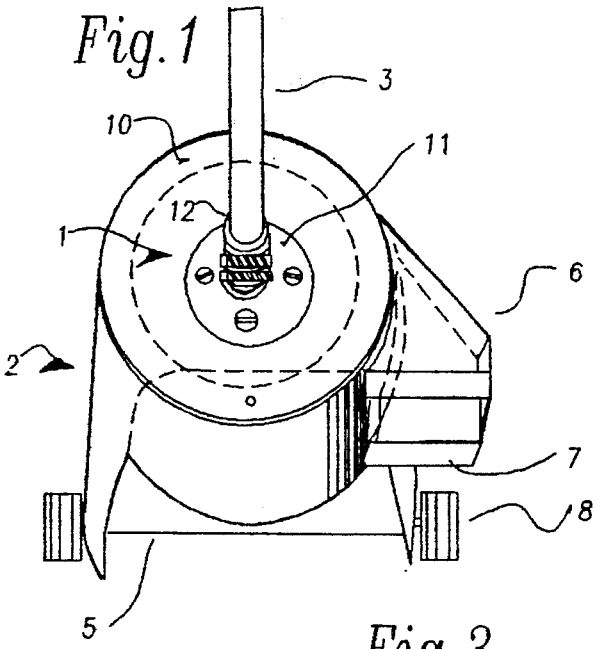
FIG. 1 is a top perspective of the snow blower shovel looking at the front view of the device.
Figure 2:
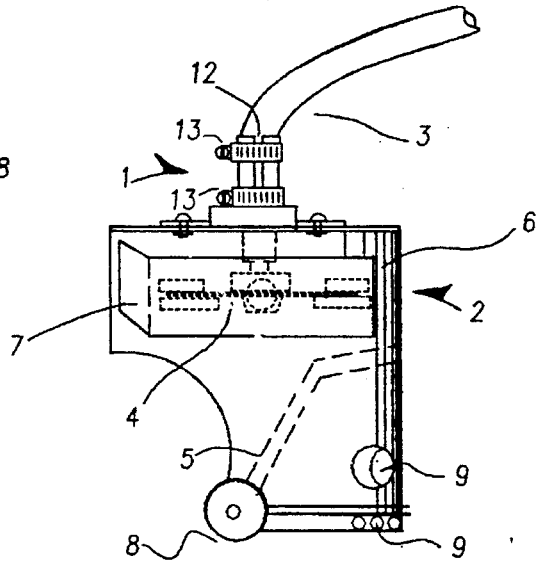
FIG. 2 is a side elevation of a snow blower shovel device in accordance with the present invention.
Figure 3:
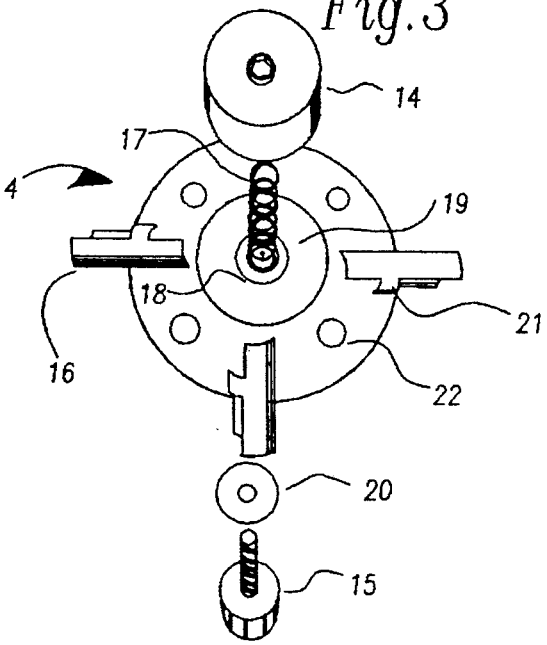
FIG. 3 is atop perspective exploded view of the impeller and the components which are used in the snow blower shovel device.
Figure 4:
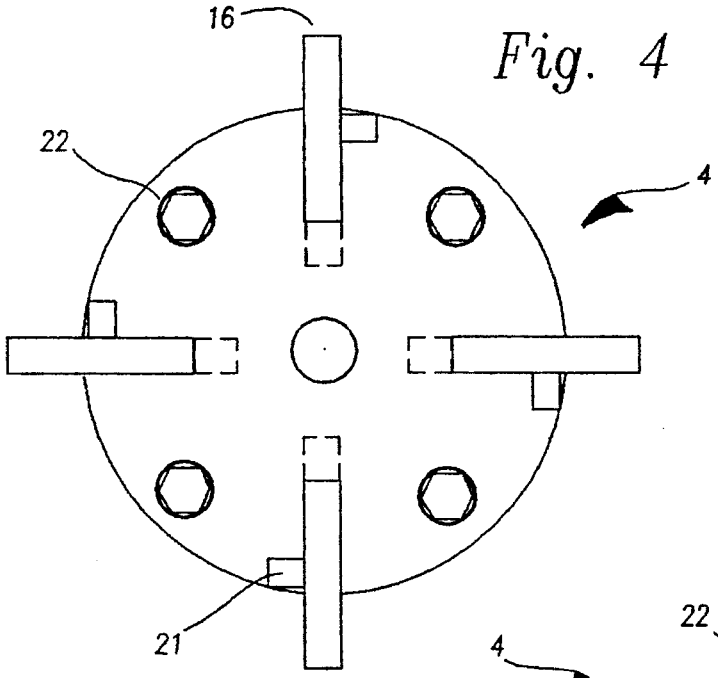
FIG. 4 is a top view of the impeller used in the snow blower shovel device.
Figure 5:
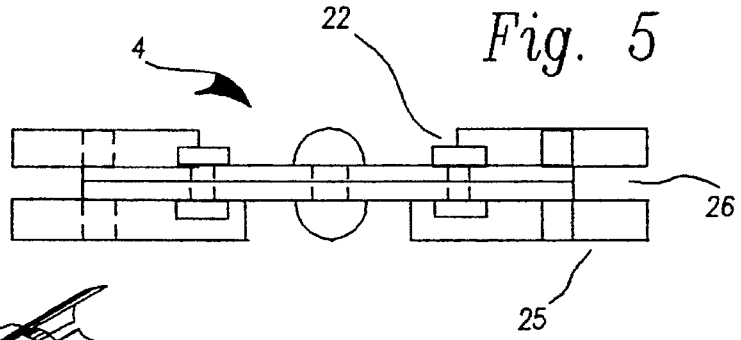
FIG. 5 is a side view of the impeller used in the snow blower shovel device.
Figure 6:
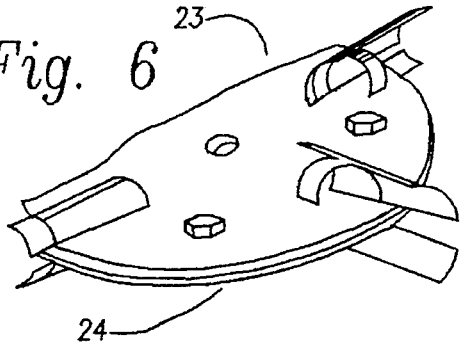
FIG. 6 is a fragmentary, top perspective of the impeller used in the snow blower shovel device.
Figure 7:
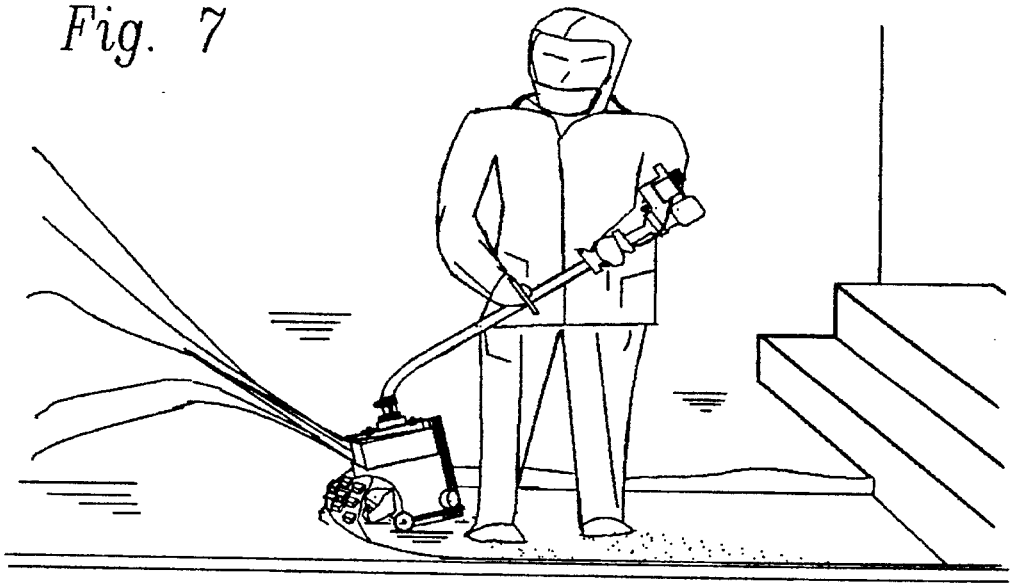
FIG. 7 walk way snow removal with snow blower shovel attachment.
Figure 8:
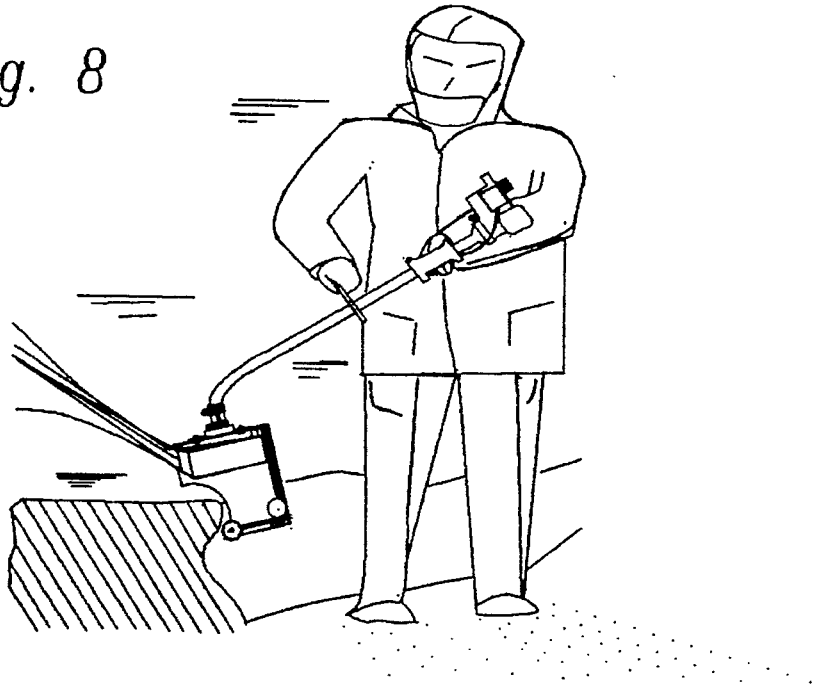
FIG. 8 removal of snow drift with Snow Blower Shovel attachment.

The preferred embodiment for the attachment snow blower shovel device is illustrated in FIG. 2, which shows details of attachment construction showing fixture 1 for connecting and supporting the total enclosure 2 to drive tube 3 of a string trimmer. The trimmer drive tube 3 provides a power take-off which rotates the impeller 4 within and adjacent the top of the the total enclosure 2. The flat plate 5 which functions as an inclined plane forcing the incoming media to the level of the impeller 4 where the velocity of the media is increased by the impeller. The media having sufficient velocity, leaves the total enclosure 2 through an opening that is covered by media exit conduit 6. The media exit conduit 6 causes the media to flow into the nozzle 7. The nozzle 7 is angled to increase the distance the media travels from the snow blower shovel to the user-selected dump area and guides media away from operator. The ability to control the selected dump area is obtained by simply turning the drive tube 3 which in turn gives a new direction to the nozzle. The holes a prevent build up of trapped snow and ice under the flat plate and reduce weight. The snow blower shovel has maneuverablity since the engine weight is opposite the preferred embodiment in FIG. 1 with wheels 8 to reduce friction. The snow blower shovel is light in weight, the prototype being only 1.98 Kg, and constructed of a variety of plastic parts. The total enclosure 2 is made from a polyethylene five gallon pail. The flat plate 5 is (1.588 mm) galvanized steel and bolted to the total enclosure 2. The exit conduit 6 and nozzle 7 are made of sheet polystyrene by thermal forming and bolted to the total enclosure 2. To prevent the total enclosure 2 and the fixture 1 from flexing 0.1175 cm phenolic sheet 10 stiffens the polyethylene surface. The fixture 1 consists of a cast iron base 11 bolted to the stiffened total enclosure 2 surface. Returning to FIG. 2 for details of fixture construction, FIG. 2 illustrates a slotted 2.54 cm polyvinyl chloride 12 fitting is compressed against curved drive tube 3 by means of two hose clamps 13. Returning to FIG. 1 the 2.54 cm polyvinyl chloride 12 fitting is connected to the threaded cast iron base 11. Further, the invention is not limited to the above list materials but these materials are listed only as a guide in construction of snow blowers for string trimmers with 2.54 cm outside diameter curved drive tube. It should be noted that the snow blower shovel fixture 1, total enclosure 2, and flat plate 5 allow possible construction differences while impeller 4 construction is more critical. The impeller is illustrated in FIG. 3 with an exploded view of the components. The impeller housing 14 and fastening bolt 15 of the original string trimmer are reused in the prototype however, other string trimmer models may require different adapters. Efficient and safe operation were major development goals. The efficient operation is limited to the power supplied by the gasoline engine of the string trimmer model. The different models and manufactures make efficient operation of the impeller 4 even more important. However, it should be noted that the operator has control of efficiency because the snow blower shovel may be operated at a lower power rate if the operator reduces the force used to push it into the media requiring less engine power added efficient operation is obtained by reducing the air resistance on the impeller 16 blades along with other methods used by those skilled in the art of rotating machinery, such as impeller 4 balance. The efficient operation does not outweigh the importance of safe operation that is provided by construction using all plastic materials excepting for spring 17, washer 18, and bolt fastener 15, which are all of the center of rotation. Further, safe operation is provided by the limited slip components. The spring 17 controls the amount of pressure exerted the housing 14 on polymeric disk 19. Further adjustments on pressure exerted are given by the fastening bolt 15 and lower washer 20. The use of metal in the impeller construction is always possible, however prototype experiments showed that metal would easily puncture media exit conduit 6 and still had enough velocity to do significant damage. FIG. 4 illustrates other important features of the impeller such as impeller blades 16 made of fiberglass reinforced resins and forming a continuous composite impeller structure with blade edge holding strap 21 keeping impeller blades 16 from changing position when rotated at high speed. The impeller 4 uses nylon bolts 22 to hold sections together as illustrated in FIG. 6 showing the top half section 23 and bottom half section 24. FIG. 5 illustrates how the impeller lower blades 25 on the bottom section are larger in size to pick up more incoming media. Air resistance is reduced by slotting in the upper and lower blades which increase the impeller 4 efficiency. The importance of impeller 4 construction in the snow blower shovel was demonstrated many times when the engine could not develope the operating speed due to air resistance of the impeller blades balance and materials problems.

What is claimed:

1. A device for removing snow from a surface, said device having a forward end and a rearward end, said device comprising:

a flat plate inclined at an angle upwardly from said surface, a total enclosure above said flat plate surrounding a rotational snow removing device, a section of said total enclosure extending downwardly proximate said rearward end, providing an attachable support for said flat plate, said rotational snow removing device comprising a substantially horizontal impeller rotating about a generally vertical axis, said impeller having a plurality of blades on a substantially circular disc, said disc surrounded by said total enclosure above said flat plate, means for admitting snow to said impeller comprising an intake opening substantially parallel to said surface, means for discharging snow from said total enclosure comprising a discharge opening in said total enclosure, means for directing snow discharged from said total enclosure into a conduit guide, said means for directing comprising an exit conduit, and means for driving said impeller, said driving means comprising an external rotary power source and means for connecting said impeller to said external rotary power source.

2. The snow removing device of claim 1 wherein the portion of said flat plate nearest said surface is adjacent to said forward end, and the portions of said flat plate farthest from said surface is adjacent to said rearward end and is below and adjacent to said intake opening in said total enclosure, wherein said flat plate is inclined from said forward end upwardly toward said rearward end.

3. The snow removing device of claim 1 wherein said intake opening is above said inclined flat plate within said total enclosure below said substantially horizontal impeller, and said discharge opening in said total enclosure is substantially tangent to said substantially horizontal impeller.

4. A portable device converting a string trimmer into a device for removing snow from a surface, said portable device comprising:

a fixture means for attaching a drive tube of said string trimmer to said portable device and supporting said portable device, a total enclosure attached to said fixture means, said total enclosure containing a rotational disc and a downwardly extending rear half section of said total enclosure supporting a snow elevating device, said snow elevating device comprising a substantially flat plate inclined above said surface and positioned below said total enclosure, said rotational disc comprising a substantially horizontal impeller within said total enclosure rotating about a vertical axis, said disc disposed above said substantially flat plate with said impeller being connected to a power take off.

means for admitting snow to said impeller comprising said substantially flat plate and an intake opening, means for discharging snow from said total enclosure comprising an opening in said total enclosure adjacent said impeller, said discharging means comprising a discharge opening, and means for directing snow discharged from said total enclosure into a conduit, said means for directing comprising an exit conduit.

5. The portable device of claim 4 wherein said fixture means attaches said portable device to said drive tube, and a rotational power source for said device is disposed at an opposite end of said drive tube.

6. The portable device of claim 4 wherein said exit conduit comprises a snow collecting manifold wherein fractured ice crystals dispersed in air are expected from said snow removal device in the direction of said exit conduit.

7. The portable device of claim 4 wherein said fixture means comprises a concentric base with an inner portion connected to a supporting stem, said supporting stem connected to said string trimmer drive tube, said supporting stem slotted along a longitudinal axis.

* * * * *